US011058142B1

(12) United States Patent
Cassels-Smith et al.

(10) Patent No.: US 11,058,142 B1
(45) Date of Patent: Jul. 13, 2021

(54) SHISHA, HEAT-NOT-BURN, OR COMBUSTION CASING WITH ACTIVE INGREDIENT, PRODUCT AND CASING WITH ACTIVE INGREDIENT, AND METHOD OF MAKING THE SAME

(71) Applicant: Tobacco Technology, Inc., Eldersburg, MD (US)

(72) Inventors: George Hiram Cassels-Smith, Eldersburg, MD (US); John Craig Senatore, Baltimore, MD (US); Nichollas James Hill, Owings Mils, MD (US)

(73) Assignee: Tobacco Technology, Inc., Eldersburg, MD (US)

( * ) Notice: Subject to any disclaimer, the term of this patent is extended or adjusted under 35 U.S.C. 154(b) by 0 days.

(21) Appl. No.: 17/061,535

(22) Filed: Oct. 1, 2020

(51) Int. Cl.

| | |
|---|---|
| ***A24B 15/16*** | (2020.01) |
| ***A24B 15/30*** | (2006.01) |
| ***A24B 15/32*** | (2006.01) |
| ***A24B 15/34*** | (2006.01) |
| ***A24B 15/40*** | (2006.01) |

(52) U.S. Cl.
CPC ..... *A24B 15/16* (2013.01); *A24B 15/301* (2013.01); *A24B 15/303* (2013.01); *A24B 15/32* (2013.01); *A24B 15/34* (2013.01); *A24B 15/403* (2013.01)

(58) Field of Classification Search
None
See application file for complete search history.

(56) References Cited

U.S. PATENT DOCUMENTS

| | | | | |
|---|---|---|---|---|
| 9,022,041 | B2 * | 5/2015 | Masri | A24D 1/18 131/359 |
| 2006/0254606 | A1 * | 11/2006 | Fazlani | A24B 15/30 131/352 |
| 2020/0253269 | A1 * | 8/2020 | Rousseau | A24D 1/002 |

OTHER PUBLICATIONS

Metabocard for Methyl phenylacetate, The Metabionics Innnovation Centre, no date, [online], retrieved from the Internet,[retrieved Nov. 19, 2020],<URL: https://hmdb.ca/metabolites/HMDB0032617>. (Year: 2020).*

* cited by examiner

*Primary Examiner* — Dennis R Cordray
(74) *Attorney, Agent, or Firm* — Troutman Pepper Hamilton Sanders LLP; Christopher J. Forstner; Scott A. Bergeson

(57) ABSTRACT

A shisha, heat-not-burn, or combustion product casing including an active ingredient, a shisha, heat-not-burn, or a combustion product including a casing with an active ingredient, or a method of making the same are disclose herein.

22 Claims, 5 Drawing Sheets

SHISHA, HEAT-NOT-BURN, OR COMBUSTION CASING WITH ACTIVE INGREDIENT, PRODUCT AND CASING WITH ACTIVE INGREDIENT, AND METHOD OF MAKING THE SAME

FIELD OF THE DISCLOSURE

The present disclosure relates generally to a shisha, heat-not-burn, or combustion product casing including one or more active ingredients, a shisha, heat-not-burn, or a combustion product including a casing with an active ingredient, or a method of making the same. In particular, the present disclosure generally relates to precisely dosing a shisha, a heat-not-burn, or a combustion substrate with one or more active ingredients contained within a casing.

BACKGROUND

Accurately, dosing an active ingredient (e.g., nicotine and/or one or more cannabinoids) in shisha, heat-not-burn, and combustion products will be critical as they become more regulated in the United States and other countries. Currently, shisha, heat-not-burn, and combustion products are limited to the amount of the active ingredient contained in the substrate of their product. Such products are unable to contain higher levels of the active ingredient than what is naturally available in the substrate. Adding an active ingredient directly to a substrate may result in oversaturation of the substrate causing it to not properly uptake the required amount of casing for combustion. And adding an active ingredient directly to the substrate may result in an unknown quantity of the active ingredient being absorbed because the substrate does not absorb all of the added active ingredient. Put another way, a shisha, heat-not-burn, or combustion substrate can only absorb a limited amount of active ingredient making it impossible to increase the amount of an active ingredient in a shisha, heat-not-burn, and combustion product in a controlled manner.

Accordingly, there is a need to accurately dose shisha, heat-not-burn, and combustion products with a desired amount of an active ingredient. Embodiments of the present disclosure are directed to this and other considerations.

SUMMARY

Briefly described, embodiments of the presently disclosed subject matter generally relate to a shisha, heat-not-burn, or combustion casing including an active ingredient, a shisha, heat-not-burn, or combustion product with a casing including an active ingredient, and a method of making the same.

A shisha, heat-not-burn, or combustion product may include a substrate; and a casing at least partially absorbed by the substrate. The casing may include an active ingredient.

A shisha, heat-not-burn, or combustion product casing may include one or more humectants in an amount of approximately 1 to 99.99% by weight of a total weight of the product casing. The product casing may also include one or more preservatives in an amount of approximately 0 to 20% by weight of the total weight of the product casing. The product casing may also include one or more additives in an amount of approximately 0 to 99% by weight of the total weight of the product casing. The product casing may also include one or more active ingredients in an amount of approximately 0.1 to 50% by weight of the total weight of the product casing.

A method of making a shisha, heat-not-burn, or combustion product with enhanced active ingredient may include adding the product casing described above to a shisha, heat-not-burn, or combustion product substrate and allowing the substrate to absorb the product casing.

A method of making a shisha, heat-not-burn, or combustion product casing may include adding one or more active ingredients to one or more humectants to create a first composition.

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
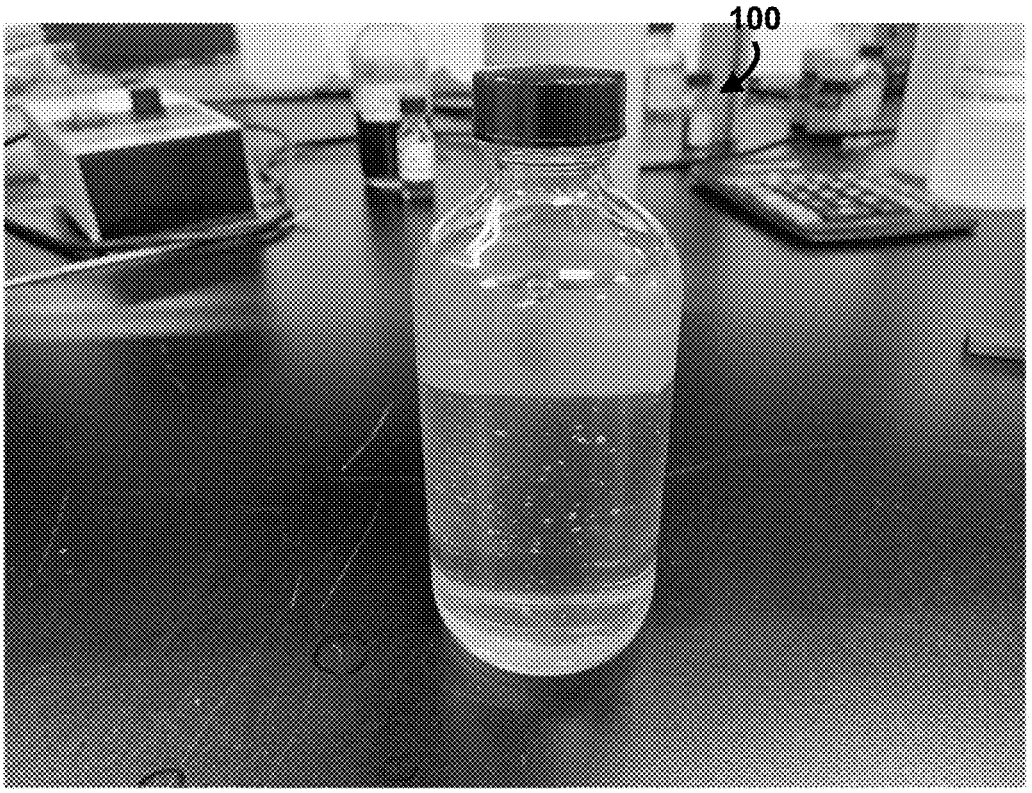
FIG. 1 shows an exemplary product casing for adding an active ingredient to a shisha, heat-not-burn, or combustion substrate.

Although certain embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical range and sub-range is explicitly recited. For example, a range of approximately 1 to 99.99 should be interpreted to include not only the explicitly recited limits of approximately 1 and approximately 99.99, but also individual amounts such as 2, 3, 4, 5.01, 5.02, 99.98, etc., and sub ranges such as 5 to 80 and 30.21 to 83.24, etc. Similarly, it should be understood that when numerical ranges are provided, such ranges are to be construed as providing literal support for claim limitations that only recite the lower value of the range as well as claim limitations that only recite the upper value of the range. For example, a disclosed numerical range of 5 to 15 provides literal support for a claim reciting "greater than 5" (with no upper bounds) and a claim reciting "less than 15" (with no lower bounds).

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

FIG. 1 shows an exemplary product casing 100 for adding an active ingredient to a shisha, heat-not-burn, or combustion substrate. The product casing may be a liquid compound as shown and is intended to be used with a shisha, heat-not-burn, or combustion substrate to precisely add a given amount of an active ingredient to the selected substrate. The active ingredient may be in an amount of approximately 0.1 to 99% by weight of the total weight of the product casing. The active ingredient may be nicotine or a cannabinoid (e.g., tetrahydrocannabinolic acid (THCA), tetrahydrocannabinol (THC), cannabidiolic acid (CBDA), cannabidivarin (CBDV), cannabidiol (CBD), cannabinol (CBN) cannabigerol (CBG), cannabichromene (CBC), and/or tetrahydrocannabivarin (THCV)), or a combination thereof. Examples of the substrate may include hemp (e.g., hemp reconstitutes), tobacco (e.g, tobacco reconstitutes), fruit, and/or any cellulosic material (e.g., lettuce).

The casing may also include one or more humectants in an amount of approximately 1 to 99.99% by weight of a total weight of the casing. The one or more humectants may include propylene glycol, glycerin, food syrup, animal biproduct (e.g., honey), 2, 3 propanediol, or a combination thereof. The precise combination of available humectants creates a blend for the optimal performance and consistency of the casing for a shisha, heat-not-burn, or combustion product.

The casing may also include one or more preservatives in an amount of approximately 0 to 20% by weight of the total weight of the casing. The one or more preservatives may include citric acid, sodium benzoate, sodium bicarbonate, potassium sorbate, propylparaben, butylated hydroxyanisole, butylated hydroxytoluene, rosemary extract, or a combination thereof. In some embodiments, the casing does not include any of the listed preservatives.

The casing may also include one or more additives in an amount of approximately 0 to 99% by weight of the total weight of the casing to make a casing that has improved smoke performance and improve the taste of the casing and substrate to which the casing is added. The one or more additives may include water, fructose crystalline, vanillin, molasses, cyclotene, maltol, ethyl vanillin, ethyl maltol, ethanol, benzyl alcohol, triacetin, one or more flavor additives, or a combination thereof. The one or more flavor additives include benzaldehyde, isoamyl hexanoate, methyl phenylacetate, phenyl ethyl phenylacetate, ethyl caproate, or a combination thereof. In some embodiments, the casing does not include any of the listed one or more additives.

Figure 2:
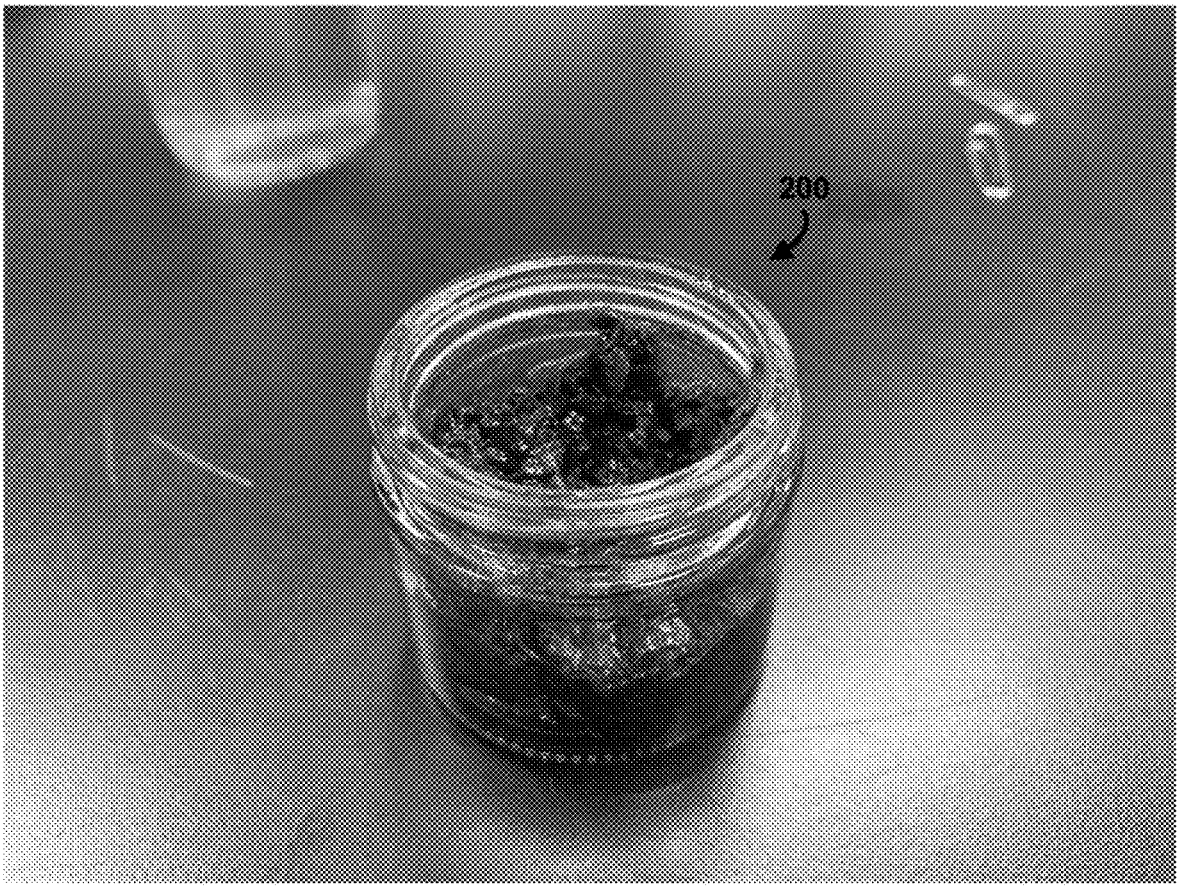
FIG. 2 shows an exemplary shisha product with a substrate that at least partially absorbed a casing containing an active ingredient.

FIG. 2 shows an exemplary shisha product with a shisha substrate that at least partially absorbed a casing containing an active ingredient. Although a shisha product and shisha substrate are used in FIG. 2, a heat-not-burn or combustion product may be created using a heat-not-burn substrate or a combustion substrate. The casing used may be the same as the casing described above.

Figure 3:
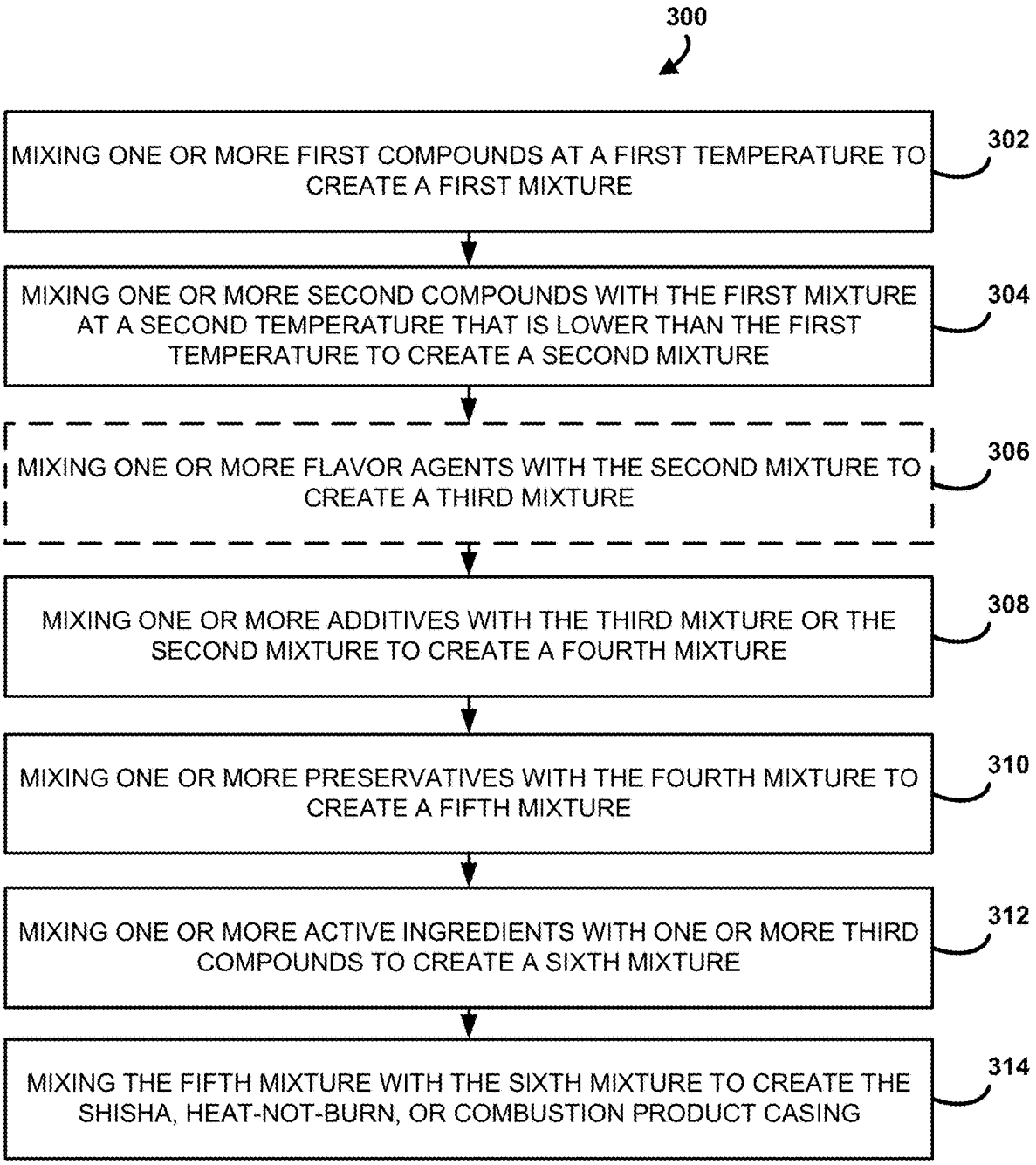
FIG. 3 shows an exemplary method for making a shisha, heat-not-burn, or combustion casing according to an embodiment of the present disclosure.

FIG. 3 shows an exemplary method 300 for making a shisha, heat-not-burn, or combustion casing according to an embodiment of the present disclosure.

In step 302, one or more first compounds are mixed at a first temperature to create a first mixture. The one or more first compounds may include propylene glycol, fructose crystalline, vanillin, citric acid, or a combination thereof. The first temperature may be approximately 80 to 150° F. (e.g., approximately 110° F.). In an embodiment, the fructose crystalline, vanillin, and/or citric acid are mixed until they are dissolved (e.g., mixed to homogeneity) in the propylene glycol. The amount of the propylene glycol in the product casing may be approximately 5 to 90 weight percent of a total weight of the product casing. The amount of the fructose crystalline in the product casing may be approximately 0.1 to 7.5 weight percent of the total weight of the product casing. The amount of the vanillin in the product casing may be approximately 0.0001 to 0.01 weight percent of the total weight of the product casing. The amount of the citric acid in the product casing may be approximately 0.05 to 5 weight percent of the total weight of the product casing.

In step 304, one or more second compounds are mixed with the first mixture at a second temperature that is lower than the first temperature to create a second mixture. The second compounds may include corn syrup, glycerine, or a combination thereof. The second temperature may be approximately 80 to 120° F. (e.g., approximately 100° F.). The amount of the corn syrup in the product casing may be approximately 1 to 25 weight percent of the total weight of the product casing. The amount of the glycerine in the product casing may be approximately 5 to 95 weight percent of the total weight of the product casing.

In step 306, one or more flavor agents are optionally mixed with the second mixture to create a third mixture. The one or more flavor agents may include benzaldehyde, isoamyl hexanoate, methyl phenylacetate, phenyl ethyl phenylacetate, ethyl caproate, or a combination thereof. The amount of the benzaldehyde in the product casing may be approximately 0.00001 to 0.001 weight percent of the total weight of the product casing. The amount of the isoamyl hexanoate in the product casing may be approximately 0.00001 to 0.001 weight percent of the total weight of the product casing. The amount of the methyl phenylacetate in the shisha casing may be approximately 0.01 to 0.1 weight percent of the total weight of the product casing. The amount of the phenyl ethyl phenylacetate in the product casing may be approximately 0.00001 to 0.001 weight percent of the total weight of the product casing. The amount of the ethyl caproate in the product casing may be approximately 0.00001 to 0.001 weight percent of the total weight of the product casing.

In step 308, one or more additives are mixed with the third mixture or the second mixture to create a fourth mixture. The one or more additives may include water. The amount of the water in the product casing may be approximately 0.01 to 0.1 weight percent of the total weight of the product casing.

In step 310, one or more preservatives are mixed with the fourth mixture to create a fifth mixture. The one or more preservatives may include sodium bicarbonate, potassium sorbate, proylparaben, or a combination thereof. The amount of the sodium bicarbonate in the product casing may be approximately 0.01 to 0.1 weight percent of the total weight of the product casing. The amount of the potassium sorbate in the product casing may be approximately 0.001 to 0.1 weight percent of the total weight of the product casing. The amount of the sodium benzoate in the product casing may be approximately 0.001 to 0.1 weight percent of the total weight of the product casing. The amount of the propylparaben in the product casing may be approximately 0.0001 to 0.01 weight percent of the total weight of the product casing.

In step 312, one or more active ingredients are mixed with one or more third compounds to create a sixth mixture. The one or more active ingredients may include cannabidiol, nicotine, tetrahydrocannabinol, or a combination thereof. The amount of the one or more active ingredients may be approximately 5 to 60 weight percent of the sixth mixture of propylene glycol and the one or more active ingredients. The amount of the sixth mixture may be approximately 0.1 to 10 weight percent of the total weight of the product casing.

It should be noted that prior to creating the sixth mixture, one may determine, identify, or receive the amount of the one or more active ingredients in a target substrate of the end shisha, heat-not-burn, or combustion product. Once the amount of the one or more active ingredients in the target substrate is known or calculated, the precise amount of one or more active ingredient for the casing may be calculated to achieve a desired total amount of the one or more active ingredients in the end shisha, heat-not-burn, or combustion product (substrate plus casing).

In step 314, the fifth mixture is mixed with the sixth mixture to create the shisha, heat-not-burn, or combustion product casing.

Figure 4:
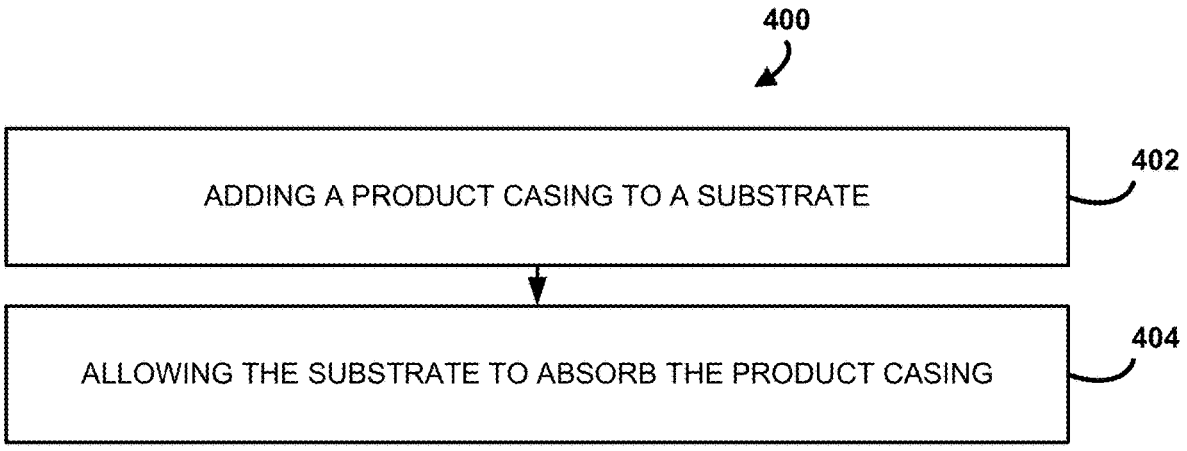
FIG. 4 shows an exemplary method for a shisha, heat-not-burn, or combustion product according to an embodiment of the present disclosure.

FIG. 4 shows an exemplary method 400 for a shisha, heat-not-burn, or combustion product according to an embodiment of the present disclosure.

In step 402, a product casing as described above is added to a substrate.

In step 404, the substrate is allowed to absorb the product casing. Allowing the substrate to absorb the product casing may include letting the combined substrate and product casing to equilibrate for approximately 0 minutes to 2 weeks (e.g., approximately 24 hours) at 50 to 100° F. (e.g., approximately 70° F.). In some embodiments, the product casing and the substrate may be gently tumbled (e.g., using a tumbler) for approximately 0 seconds to 2 hours. In other embodiments, the product casing may be mixed or stirred with the substrate for approximately 0 seconds to 2 hours.

Figure 5:
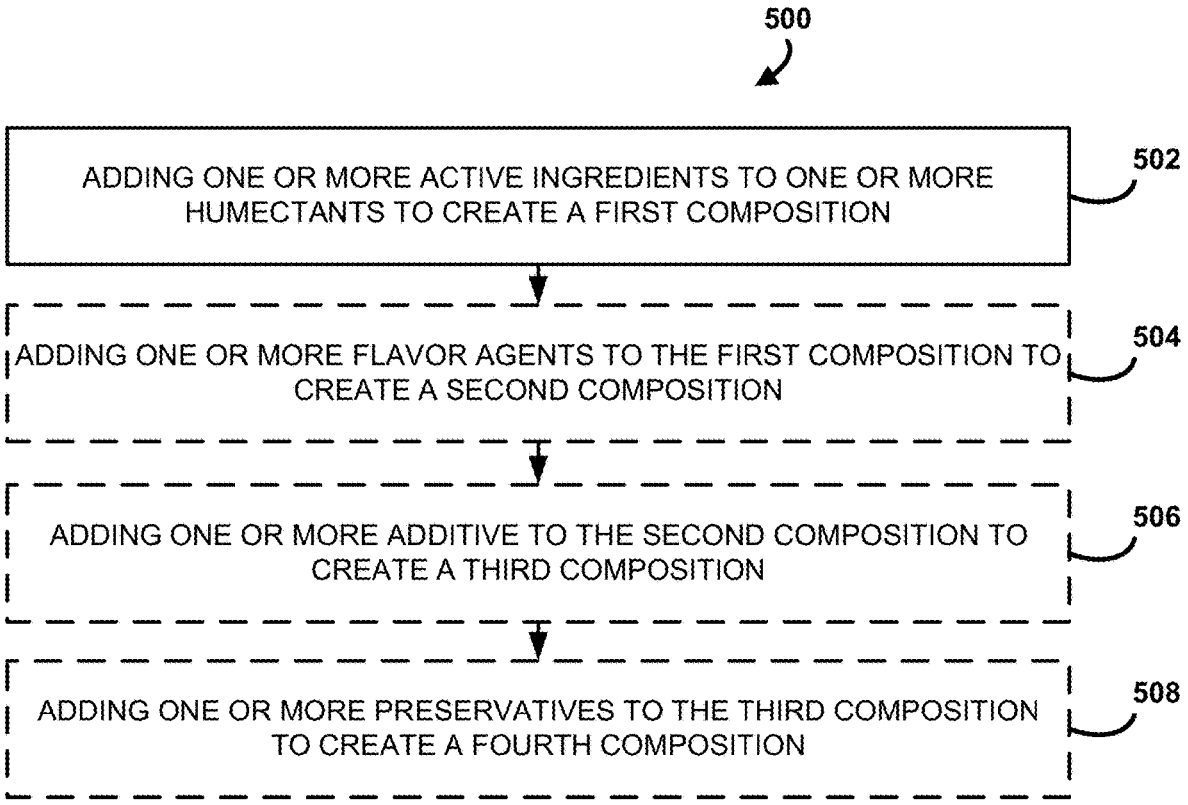
FIG. 5 shows another exemplary method for a shisha, heat-not-burn, or combustion casing according to an embodiment of the present disclosure.

FIG. 5 shows another exemplary method 500 for making a shisha, heat-not-burn, or combustion casing according to an embodiment of the present disclosure.

In step 502, one or more active ingredients are added to one or more humectants to create a first composition.

In optional step 504, one or more flavor agents are added to the first composition to create a second composition.

In optional step 506, one or more additives are added to the second composition to create a third composition.

In optional step 508, one or more preservatives are added to the third composition to create a fourth composition. The first composition, the second composition, the third composition, and the fourth composition may each be mixed for approximately 0 to 50 minutes.

The one or more humectants may include propylene glycol, food syrup, glycerin, animal biproduct, 2, 3 propanediol, or a combination thereof, The one or more flavor agents may include benzaldehyde, isoamyl hexanoate, methyl phenylacetate, phenyl ethyl phenylacetate, ethyl caproate, or a combination thereof. The one or more additives may include water, fructose crystalline, vanillin, molasses, cyclotene, maltol, ethyl vanillin, ethyl maltol, ethanol, benzyl alcohol, triacetin, or a combination thereof. The one or more preservatives may include sodium bicarbonate, potassium sorbate, proylparaben, or a combination thereof. The one or more active ingredients may include nicotine or a cannabinoid (e.g., tetrahydrocannabinolic acid (THCA), tetrahydrocannabinol (THC), cannabidiolic acid (CBDA), cannabidivarin (CBDV), cannabidiol (CBD), cannabinol (CBN) cannabigerol (CBG), cannabichromene (CBC), and/or tetrahydrocannabivarin (THCV)), or a combination thereof.

In an embodiment, the amount of the first propylene glycol in the product casing may be approximately 5 to 90 weight percent of a total weight of the product casing. The amount of the fructose crystalline in the product casing may be approximately 0.1 to 7.5 weight percent of the total weight of the product casing. The amount of the vanillin in the product casing is approximately 0.0001 to 0.01 weight percent of the total weight of the product casing. The amount of the citric acid in the product casing may be approximately 0.05 to 5 weight percent of the total weight of the product casing. The amount of the corn syrup in the product casing may be approximately 1 to 25 weight percent of the total weight of the product casing. The amount of the glycerin in the product casing may be approximately 5 to 95 weight percent of the total weight of the product casing. The amount of the benzaldehyde in the product casing may be approximately 0.00001 to 10 weight percent of the total weight of the product casing. The amount of the isoamyl hexanoate in the product casing may be approximately 0.00001 to 10 weight percent of the total weight of the product casing. The amount of the methyl phenylacetate in the shisha casing may be approximately 0.01 to 10 weight percent of the total weight of the product casing. The amount of the phenyl ethyl phenylacetate in the product casing may be approximately 0.00001 to 10 weight percent of the total weight of the product casing. The amount of the ethyl caproate in the product casing may be approximately 0.00001 to 10 weight percent of the total weight of the product casing. The amount of the water in the product casing may be approximately 0.01 to 10 weight percent of the total weight of the product casing. The amount of the sodium bicarbonate in the product casing may be approximately 0.01 to 10 weight percent of the total weight of the product casing. The amount of the potassium sorbate in the product casing may be approximately 0.001 to 10 weight percent of the total weight of the product casing. The amount of the sodium benzoate in the product casing may be approximately 0.001 to 10 weight percent of the total weight of the product casing. The amount of the propyl paraben in the product casing may be approximately 0.0001 to 10 weight percent of the total weight of the product casing. The amount of the one or more active ingredients may be approximately 1 to 99 weight percent of the product casing.

The following examples are provided by way of illustration but not by way of limitation.

EXAMPLES

Example 1: 100 g Casing with Cannabidiol as Active Ingredient 2.6 grams of fructose crystalline, 0.0013 grams of vanillin, and 1.1 grams of critic acid (granular) are added to and mix with 36.9 grams of propylene glycol under slight heat (approximately 110° F.) until the fructose crystalline, vanillin, and critic acid are dissolved into a first mixture. 10 grams of corn syrup and 48 grams of glycerine are added to and mixed with the first mixture with slight heat not to exceed approximately 100° F. until the corn syrup and glycerine are dissolved into a second mixture. Add and mix with the second mixture 0.0004 grams of benzaldehyde, 0.0002 grams of isoamyl hexanoate, 0.0170 grams of methyl phenylacetate, 0.0009 grams of phenyl ethyl phenylacetate, and 0.0002 grams of ethyl caproate for approximately 30 minutes to create a third mixture. Separately add 0.0672 grams of water, 0.0015 grams of sodium bicarbonate, 0.0149 grams of potassium sorbate, 0.0149 of sodium benzoate, and 0.0015 grams of propyl paraben to the third mixture and mix until dissolved without heat. Add 1.38 grams of cannabidiol (CBD) 35% propylene glycol concentrate. This resulting mixture is shown in FIG. 1.

Example 2: CBD Shisha Product

The casing as prepared in Example 1 was added to and mixed with a reconstituted hemp (hemp cast to a paper and shredded to 1" square pieces) substrate until homogeneity is achieved to create a shisha product with 483 milligrams per 100 grams. of CBD shown in FIG. 2.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

Example 3: 100 g Casing with Cannabidiol (CBD) as Active Ingredient

Add 31.8327 grams of propylene glycol and 1.38 grams of CBD isolate (hemp extract) 99.6% to 50 grams of glycerin and mix until the propylene glycol and CBD isolate are dissolved to create a first mixture. Add 2.5 grams of fructose crystalline to the first mixture, heat to 120° F. while mixing until the fructose crystalline is dissolved to create a third mixture. Add 0.9461 grams of molasses, 0.0531 grams of caramel color #525, 0.0006 grams of maltol, 0.0002 grams of licorice, 12 grams of corm syrup, 1.1 grams of citric acid, 0.01 grams of vanillin, 0.0027 grams of benzaldehyde, 0.0015 grams of isoamyl hexanoate, 0.1274 grams of methyl phenylacetate, 0.0066 grams of phenyl ethyl phenylacetate, 0.0018 grams of ethyl caproate, 0.0360 grams of carmel color (maillose), and 0.0013 grams of carmel color #9 to the third mixture and mix for 20 to 30 minutes.

Example 4: 100 g Casing with Nicotine as Active Ingredient

Mix 53.5224 grams of glycerine, 5.0081 grams of water, 1.9225 grams of fructose crystalline, 14.4957 grams of corn syrup, 0.0961 grams of sodium benzoate, 0.0019 grams of sodium bicarbonate, 0.0192 grams of potassium sorbate, 0.0019 grams of propyl paraben, 0.2019 grams of propylene glycol, 0.6844 grams of molasses, 0.385 grams of carmel color #525, 0.461 grams of licorice, 0.8459 grams of citric acid, 0.0115 grams of honey, 0.0028 grams of carmel color (maillose), and 0.0011 grams of carmel color #9 for 20 minutes. Add 23.1 grams of nicotine 20% propylene glycol concentrate and mix for 20 minutes.

What is claimed is:

1. A shisha, heat-not-burn, or combustion product, comprising:

a substrate; and a casing at least partially absorbed by the substrate, wherein the casing comprises one or more additives and an active ingredient, and wherein the one or more additives comprise one or more flavor additives comprising benzaldehyde, isoamyl hexanoate, phenyl ethyl phenylacetate, ethyl caproate, or a combination thereof.

2. The product of claim 1, wherein the casing further comprises one or more humectants in an amount of approximately 1 to 99.99% by weight of a total weight of the casing.

3. The product of claim 2, wherein the one or more humectants comprise casing further comprises propylene glycol, glycerin, food syrup, animal biproduct, 2, 3 propanediol, or a combination thereof.

4. The product of claim 3, wherein the casing further comprises one or more preservatives in an amount of approximately 0.1 to 20% by weight of the total weight of the casing.

5. The product of claim 4, wherein the one or more preservatives comprise citric acid, sodium benzoate, sodium bicarbonate, potassium sorbate, propylparaben, butylated hydroxyanisole, butylated hydroxytoluene, rosemary extract, or a combination thereof.

6. The product of claim 5, further comprising the one or more additives in an amount of approximately 0.00001 to 99% by weight of the total weight of the casing.

7. The product of claim 6, wherein the one or more additives further comprise water, fructose crystalline, vanillin, molasses, cyclotene, maltol, ethyl vanillin, ethyl maltol, ethanol, benzyl alcohol, triacetin, or a combination thereof.

8. The product of claim 7, wherein the one or more flavor additives further comprise methyl phenylacetate.

9. The product of claim 8, wherein the active ingredient comprises an amount of approximately 0.1 to 99% by weight of the total weight of the casing.

10. The product of claim 9, wherein the active ingredient comprises nicotine, tetrahydrocannabinolic acid (THCA), tetrahydrocannabinol (THC), cannabidiolic acid (CBDA), cannabidivarin (CBDV), cannabidiol (CBD), cannabinol (CBN) cannabigerol (CBG), cannabichromene (CBC), tetrahydrocannabivarin (THCV)), or a combination thereof.

11. The product of claim 10, wherein the substrate comprises hemp, tobacco, fruit, a cellulosic material, or a combination thereof.

12. A shisha, heat-not-burn, or combustion product casing, comprising:

one or more humectants in an amount of approximately 1 to 99.99% by weight of a total weight of the product casing;

one or more preservatives in an amount of approximately 0.1 to 20% by weight of the total weight of the product casing;

one or more additives in an amount of approximately 0.00001 to 99% by weight of the total weight of the product casing; and one or more active ingredients in an amount of approximately 0.1 to 99% by weight of the total weight of the product casing, wherein the one or more additives comprise one or more flavor additives comprising benzaldehyde, isoamyl hexanoate, phenyl ethyl phenylacetate, ethyl caproate, or a combination thereof.

13. The product casing of claim 12, wherein the one or more humectants comprise propylene glycol, glycerin, food syrup, animal biproduct, 2, 3 propanediol, or a combination thereof.

14. The product casing of claim 13, wherein the one or more preservatives comprise citric acid, sodium benzoate, sodium bicarbonate, potassium sorbate, propylparaben, butylated hydroxyanisole, butylated hydroxytoluene, rosemary extract, or a combination thereof.

15. The product casing of claim 14, wherein the one or more additives comprise water, fructose crystalline, vanillin, molasses, cyclotene, maltol, ethyl vanillin, ethyl maltol, ethanol, benzyl alcohol, triacetin, or a combination thereof.

16. The product casing of claim 12, wherein the one or more flavor additives further comprise methyl phenylacetate.

17. The product casing of claim 16, wherein the one or more active ingredients comprises cannabidiol, nicotine, tetrahydrocannabinol, or a combination thereof.

18. A method of making a shisha, heat-not-burn, or combustion product with active ingredient, comprising:

adding the product casing of claim 12 to a substrate; and allowing the substrate to absorb the product casing.

19. The method of claim 18, further comprising:

mixing the product casing with the substrate.

20. The method of claim 19, further comprising:

tumbling the product casing with the substrate.

21. A method of making a shisha, heat-not-burn, or combustion product casing, comprising:

adding one or more active ingredients to one or more humectants to create a first composition;

adding one or more flavor agents to the first composition to create a second composition;

adding one or more additives with the second composition to create a third composition; and adding one or more preservatives to the third composition to create a fourth composition, wherein:

the one or more humectants comprise propylene glycol, corn syrup and glycerin, the one or more additives comprise water, fructose crystalline, vanillin, and citric acid, the one or more flavor agents comprise benzaldehyde, isoamyl hexanoate, methyl phenylacetate, phenyl ethyl phenylacetate, and ethyl caproate, the one or more preservatives comprise sodium bicarbonate, potassium sorbate, and propyl paraben, an amount of the propylene glycol in the product casing is approximately 5 to 90 weight percent of a total weight of the product casing, an amount of the fructose crystalline in the product casing is approximately 0.1 to 7.5 weight percent of the total weight of the product casing, an amount of the vanillin in the product casing is approximately 0.0001 to 0.01 weight percent of the total weight of the product casing, an amount of the citric acid in the product casing is approximately 0.05 to 5 weight percent of the total weight of the product casing, an amount of the corn syrup in the product casing is approximately 1 to 25 weight percent of the total weight of the product casing, an amount of the glycerin in the product casing is approximately 5 to 95 weight percent of the total weight of the product casing, an amount of the benzaldehyde in the product casing is approximately 0.00001 to 10 weight percent of the total weight of the product casing, an amount of the isoamyl hexanoate in the product casing is approximately 0.00001 to 10 weight percent of the total weight of the product casing, an amount of the methyl phenylacetate in the shisha casing is approximately 0.01 to 10 weight percent of the total weight of the product casing, an amount of the phenyl ethyl phenylacetate in the product casing is approximately 0.00001 to 10 weight percent of the total weight of the product casing, an amount of the ethyl caproate in the product casing is approximately 0.00001 to 10 weight percent of the total weight of the product casing, an amount of the water in the product casing is approximately 0.01 to 10 weight percent of the total weight of the product casing, an amount of the sodium bicarbonate in the product casing is approximately 0.01 to 10 weight percent of the total weight of the product casing, an amount of the potassium sorbate in the product casing is approximately 0.001 to 10 weight percent of the total weight of the product casing, an amount of the propyl paraben in the product casing is approximately 0.0001 to 10 weight percent of the total weight of the product casing, and an amount of the one or more active ingredients is approximately 1 to 99 weight percent of the total weight of the product casing.

22. The method of claim 21, wherein the first composition, the second composition, the third composition, and the fourth composition are each mixed for 1 to 50 minutes.

* * * * *